US005291121A

United States Patent [19]

Neale et al.

[11] Patent Number: 5,291,121

[45] Date of Patent: Mar. 1, 1994

[54] RAIL SPLITTING VIRTUAL GROUND GENERATOR FOR SINGLE SUPPLY SYSTEMS

[75] Inventors: Todd M. Neale, Carrollton; Brad P. Whitney, Garland; Mark E. Granahan, Dallas, all of Tex.

[73] Assignee: Texas Instruments Incorporated, Dallas, Tex.

[21] Appl. No.: 856,856

[22] Filed: Mar. 24, 1992

Related U.S. Application Data

[63] Continuation of Ser. No. 758,039, Sep. 12, 1991, abandoned.

[51] Int. Cl.[5] ..... G05F 3/16

[52] U.S. Cl. ..... 323/313; 323/907

[58] Field of Search ..... 323/311, 312, 313, 314, 323/907

[56] References Cited

U.S. PATENT DOCUMENTS

| | | | |
|---|---|---|---|
| 3,634,751 | 1/1972 | Miller | 323/313 |
| 4,055,777 | 10/1977 | Black | 307/265 |
| 4,058,760 | 11/1977 | Ahmed | 323/314 |
| 4,100,437 | 7/1978 | Hoff | 323/314 |
| 4,250,445 | 2/1981 | Brokaw | 323/313 |
| 4,260,946 | 4/1981 | Wheatley | 323/314 |
| 4,313,083 | 1/1982 | Gilbert et al. | 323/313 |
| 4,364,006 | 12/1982 | Makabe et al. | 323/353 |
| 4,412,241 | 10/1983 | Nelson | 323/354 |
| 4,665,356 | 5/1987 | Pease | 323/907 |
| 4,713,599 | 12/1987 | Davis | 323/354 |
| 4,713,602 | 12/1987 | Ueda | 323/354 |
| 4,827,205 | 5/1989 | Hafner et al. | 323/314 |
| 5,027,053 | 6/1991 | Ohri et al. | 323/314 |
| 5,030,848 | 7/1991 | Wyatt | 323/313 |
| 5,041,795 | 8/1991 | Bowers | 307/494 |
| 5,047,707 | 9/1991 | Dixon et al. | 323/314 |
| 5,075,642 | 12/1991 | Learned | 331/143 |

*Primary Examiner*—J. L. Sterrett

*Attorney, Agent, or Firm*—Mark E. Courtney; Richard L. Donaldson

[57] ABSTRACT

A method and apparatus for a circuit physically realizing a virtual ground function producing a virtual ground voltage halfway between the supply and common voltages and having improved accuracy and stability is described. A stable bias current source is coupled to a precision resistor voltage divider network, which is used as a voltage reference generator to produce a virtual ground voltage of a precise value. This reference voltage is coupled to an operational amplifier configured in a unity gain configuration. The circuit thus created offers numerous advantages over the virtual ground circuits in use in the prior art. An integrated circuit implementing this circuit is described, and alternative packaging embodiments are disclosed. Other embodiments are also disclosed.

30 Claims, 5 Drawing Sheets

RAIL SPLITTING VIRTUAL GROUND GENERATOR FOR SINGLE SUPPLY SYSTEMS

This application is a Continuation of application Ser. No. 07/758,039, filed Sep. 12, 1991 now abandoned.

RELATED APPLICATIONS

This Application is related to co-pending Application for U.S. patent Ser. No. 758,669, filed Sep. 12, 1991 entitled "Fixed Voltage Virtual Ground Generator for Single Supply Analog Systems", incorporated herein by reference.

FIELD OF THE INVENTION

This invention generally relates to a method and apparatus for providing an improved stable and accurate virtual ground reference voltage for use in circuits wherein a single supply voltage is employed, and the virtual ground desired is to be split between the supply and common voltages.

BACKGROUND OF THE INVENTION

Without limiting the scope of the invention, its background is described in terms of virtual ground circuits used in analog system design and further in connection with an integrated circuit system which implements a convenient virtual ground circuit for use in an analog amplifier circuits using an operational amplifier, as an example.

Heretofore, in the field of single supply circuits in general, there have been several approaches to designing a virtual ground voltage reference which allow an analog circuit, for example an inverting amplifier built around an operation amplifier, to accept as input a signal centered around ground and having both positive and negative values over time, and create an output which reflects the entire waveform without loss of data due to waveform clipping. To prevent the clipping of the input waveform and a resulting loss of data, a virtual ground is required to terminate the input voltage signal and the output load and thus create an output signal which is centered around the virtual ground voltage.

Some typical approaches to designing a virtual ground voltage reference are to create voltage divider circuits using discrete components. These discrete solutions have several drawbacks which disadvantageously affect the circuits in which they are used, including poor load regulation, excessive power dissipation, large circuit board area requirements, and excessive numbers of component requirements. Accordingly, improvements which overcome any or all of these problems are presently desirable.

SUMMARY OF THE INVENTION

Generally, and in one form of the invention, a circuit is described which implements a virtual ground function, having integrated subcircuits which operate together to provide a virtual ground of half the voltage of the supply voltage. The circuit thus created has many advantages over the prior art solutions, including high current sinking and sourcing capability, highly accurate output voltage, outstanding load regulation, greatly reduced power dissipation, increased dynamic signal range, lower distortion and improved signal-to noise characteristics, and improved accuracy.

A second embodiment is described wherein the circuit is integrated and packaged in a three terminal package. When this embodiment is employed in a typical system using a single supply voltage, the invention advantageously provides a saving in board area, a reduced component count and a reduced connection count, and provides excellent ease of use characteristics in a circuit board or other highly dense circuit environments.

A further embodiment is described with an added function wherein the circuit is packaged in an eight pin DIP. In this embodiment, increased accuracy can be achieved by bonding out an additional terminal, a noise reduction pin. A capacitor coupled between the noise reduction pin and ground and the virtual ground circuit will yield an embodiment having increased noise rejection for applications wherein the maximum possible noise rejection characteristics are required.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

The virtual ground circuit of the invention makes it possible to provide a highly accurate virtual ground with outstanding load regulation, low power supply requirements, and improved noise performance over the prior art solutions. By combining a precision trimmed voltage divider with a high performance op amp having particular characteristics, a virtual ground is produced which is typically ½ of the supply voltage, although other voltages are easily produced. In the simplest embodiment, the circuit of the invention requires no additional biasing components or other connections to operate. In a second embodiment, a single additional capacitor can be used to further improve the operation of the circuit in terms of noise rejection characteristics, if necessary for a particular application.

FIG. 1 depicts four prior art solutions to the problem. In FIG. 1A, a resistor voltage divider with a filter capacitor is used to divide the power supply voltage by 2. Resistor 1 and resistor 3 provide a standard voltage divider, with capacitor 5 providing a filter to reduce noise at the output $V_o$. The circuit shown in FIG. 1A is used in many prior art applications of a virtual ground. A second prior art alternative is shown in FIG. 1B, with resistor 9 and shunt regulator 11 providing the output voltage $V_o$. This circuit is also used to provide a virtual ground in many prior art circuits. These approaches both exhibit many disadvantages, for instance the voltage divider of FIG. 1A exhibits poor input regulation because as the supply voltage varies, the output voltage $V_o$ moves approximately 50% or, for example in a 5 volt system, 0.5 V/Volt. This leads to a reduction in the usable common-mode voltage range and output swing of the circuit using the virtual ground. Power dissipation is also higher than desirable, for a typical 1-K ohm resistor divider in a 5 V system, the power dissipation is 12.5 mW DC.

Figure 1A:
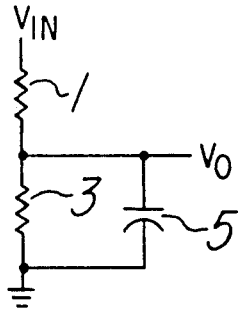
PRIOR ART FIG. 1a
FIG. 1 depicts four prior art virtual ground circuit solutions, in FIGS. 1A–1D.
Figure 1B:
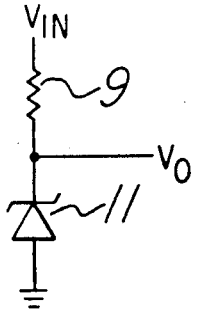
PRIOR ART FIG. 1b

FIG. 1B depicts the creation of the virtual ground using an active device, such as a voltage reference. Because all such voltage references are essential power sources, the active element is designed to either source or sink current, but not both. In the configuration shown in FIG. 1B, the resistor 9 must provide current to the load and the shunt voltage reference 11. Peak current demand will result in significant changes in the value at the $V_o$ terminal unless ample bias current is made available, which results in extra power dissipation.

Figure 1C:
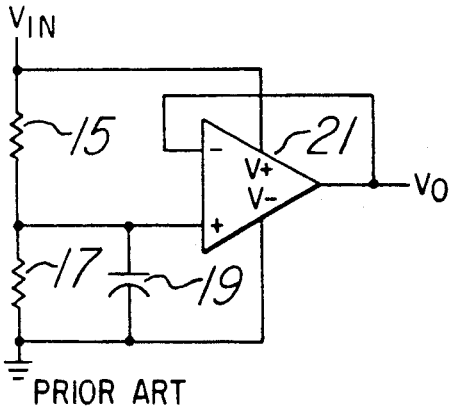
PRIOR ART FIG. 1c
Figure 1D:
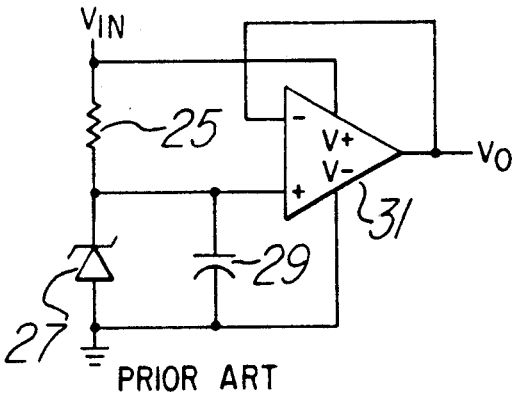
PRIOR ART FIG. 1d

FIGS. 1C and 1D depict improvements on the arrangements in FIGS. 1A and 1B, respectively, by adding a buffer to the basic virtual ground circuit. These approaches solve some of the problems, specifically the power dissipation problems. Also, input regulation due to the active reference and load regulation due to the buffer are significantly enhanced over all prior methods. The cost for these improvements is a significant increase in component count and board area.

Figure 2:
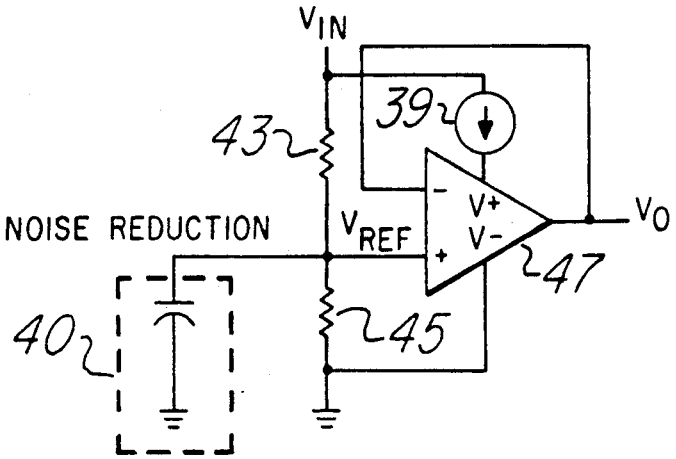
FIG. 2 is a block diagram of the virtual ground circuit of the invention.

FIG. 2 depicts a block diagram of the virtual ground circuit of the invention. A reference voltage is provided by the resistor network comprised of resistors 43 and 45. Amplifier 47 is coupled to the reference voltage and provides a buffer to the output $V_o$. Bias circuit 39 provides a temperature stable source of current to the operational amplifier for improved performance over a variety of conditions. At the reference voltage pin, an optional capacitor 40 may be coupled and further coupled to the common voltage in applications where additional improvement in noise rejection is desired.

Figure 3:
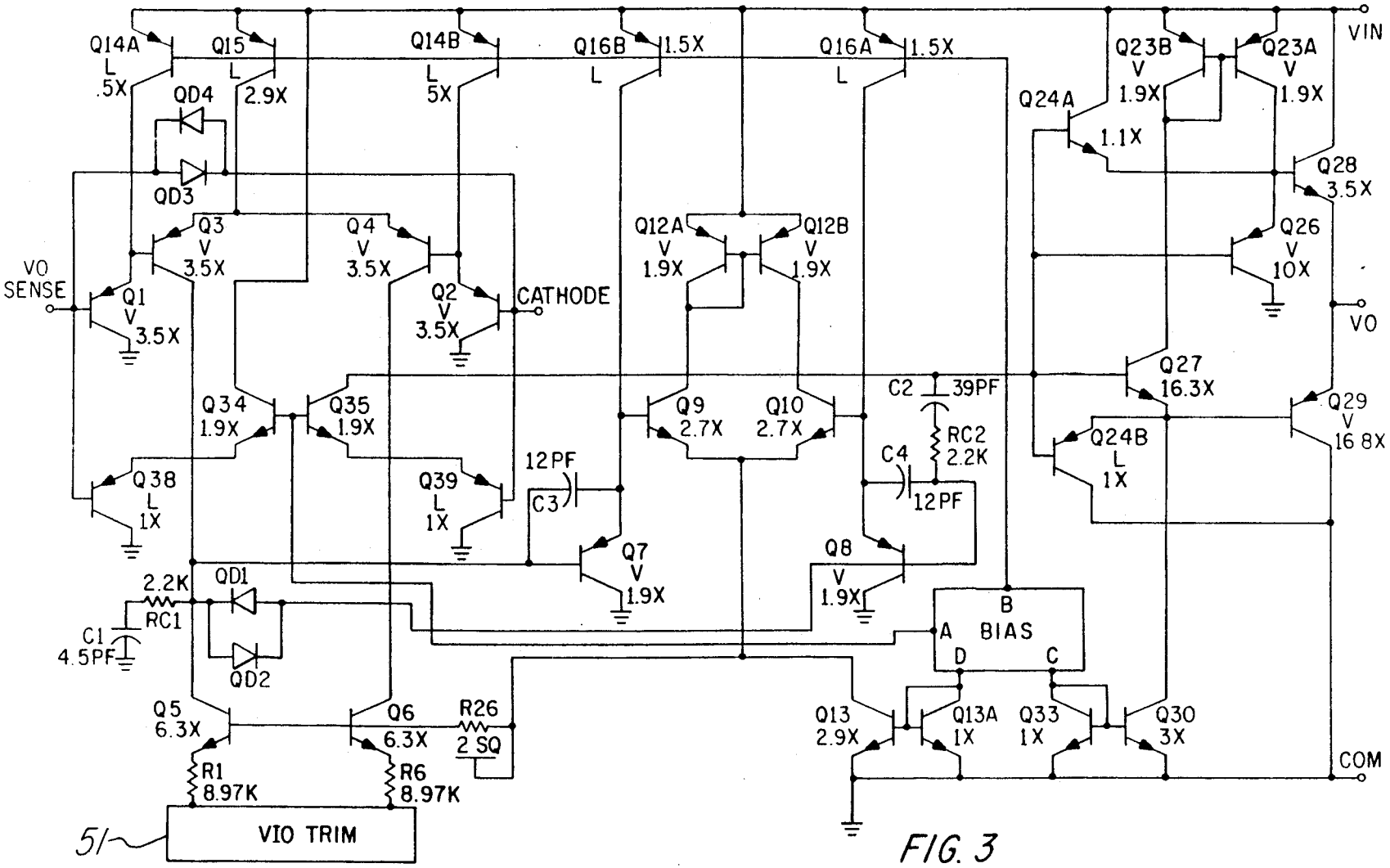
FIG. 3 is a schematic diagram of the virtual ground circuit.

FIG. 3 depicts a schematic diagram of the circuit of FIG. 2. The operational amplifier 47 from FIG. 2 is now shown in an exploded view. Resistors R10 and R11 are shown as the resistor network coupled to the operational amplifier, the bias circuit 39 is shown coupled to the operational amplifier, and the detail of the operational amplifier includes a trim circuit 51.

In operation, the resistor network comprising resistors R10 and R11 are used to develop a precision reference voltage. The op amp 47 is operated as a unity gain buffer and is connected to the bandgap reference. The output of the op amp $V_o$ is equal to the voltage reference produced by the resistor network and is the output of the virtual ground circuit. The op amp 47 is used to advantageously provide the high sink and source capability of the virtual ground circuit. The op amp 47 is also used to lower the output impedance of the virtual ground circuit. The bias circuit 39 is used to develop a reference current which is than mirrored to the rest of the circuit and is used to develop the operating point for the circuit. The trim circuit 51 is used to eliminate an error term in the virtual ground output voltage. Each circuit block depicted in FIGS. 2 and 3 was chosen for its combination of performance, stability and low-power requirements.

The op amp 47 is designed for a combination of specific DC, AC and low-power characteristics. The most interesting characteristic of op amp 47 is its ability to source and sink large load currents with only a very small quiescent current drawn from the power supply. This capability is achieved using a boost circuit comprised of Q24A and Q24B in addition to the standard output stage consisting of Q23A, Q23B, and Q26–Q30. When the current load requirement at the output exceeds the ability of the standard output stage to source or sink current, the boost circuit turns on and allows the output to source or sink additional load current. The boost circuit senses the output voltage; when the load current exceeds the capability of the standard output stage, the output voltage will move away from the desired value. The boost circuit to turns on and moves the output voltage back to the desired value while increasing the current source and sink capability. The boost circuit is turned on only when needed to keep the quiescent supply current low.

The op amp 47 was also chosen for its high DC gain. When an op amp is used in a closed-loop unity gain configuration, the output impedance is reduced from its open-loop value by the open loop gain of the op amp $A_{v(open\text{-}loop)}$.

$$R_{out:closedloop} = \frac{R_{out:openloop}}{1 + \beta A_{vopenloop}}$$

where $\beta = 1$

Output impedance of the circuit is important because as load current is sourced or sunk by the virtual ground circuit, the output voltage will tend to move away from the desired value. The higher the output impedance, the farther away the output voltage will move. Thus, reducing output impedance is a critical factor in reducing the output voltage error term due to load current. Low output impedance is achieved by using a high gain op amp in a unity gain configuration. This ability of a circuit to maintain a constant output voltage while load current is varied is known as load rejection.

High gain is achieved in op amp 47 by using many gain stages. However, using many gain stages usually degrades the frequency (AC) performance. The AC performance depends on the small-signal bandwidth of the op amp design and the speed of the process. By using the process described in U.S. Pat. No. 4,939,099; entitled "Process for Fabricating Isolated Vertical Bipolar and JFET Transistors", herein incorporated by reference, the design may achieve many advantages. The process disclosed in the patent allows the op amp 47 to use very low values of current, which contributes to the high gain and the low power consumption of the virtual ground circuit thus created. The process retains its speed at low supply currents, giving op amp 47 a high small-signal bandwidth, and as a consequence, a high full power bandwidth. The small-signal bandwidth relates directly to the virtual ground circuit's AC performance versus the frequency of the load current variation. As the frequency of the load current variation is increased beyond the full power bandwidth, the virtual grounds becomes less and less able to maintain the desired output voltage. High full power bandwidth enables the virtual ground circuit of FIGS. 2 and 3 to handle quickly changing load current without moving the output voltage $V_o$ from its desired value. Of course, any other processes may be used, but some of the advantageous features described may be lost or reduced as a result.

Figure 4A:
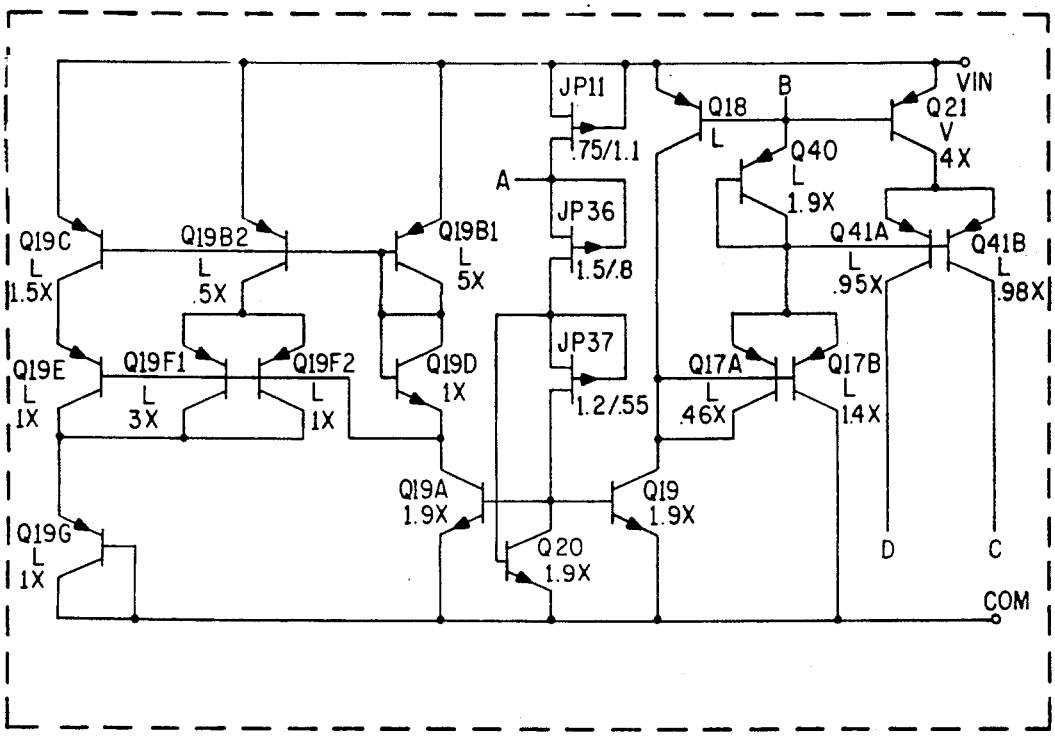
FIGS. 4*a* and 4*b* are schematic diagrams of the bias and trim circuits of the virtual ground circuit shown in FIG. 2.
Figure 4B:
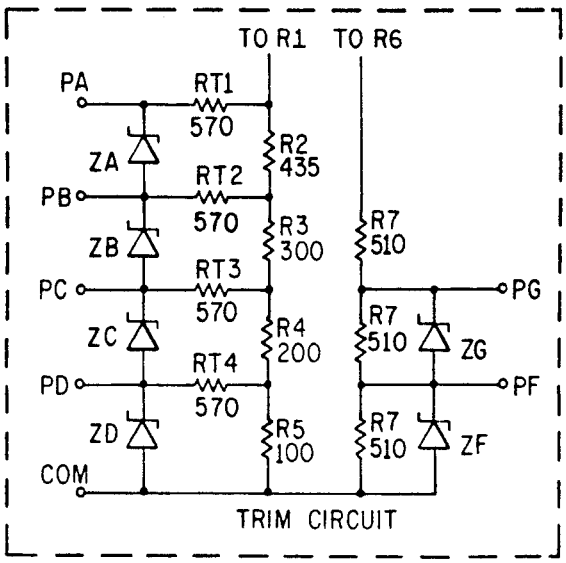

FIG. 4 depicts the schematic diagrams of the bias circuit 39 in FIG. 4A, and the trim circuit 51 in FIG. 4B.

FIG. 4A depicts the bias circuit. The core of the bias circuit is that which is described in U.S. Pat. No. 4,975,632, "Stable Bias Current Source", herein incorporated by reference. In FIG. 4A, device JP11 is a gate-source connected JFET tied to the most positive supply rail. This device is equivalent to device JP1 on the above mentioned patent. Device JP37 in FIG. 4A, another gate-source connected JFET, is equivalent to JP2 in the patent. Device Q19, an NPN bipolar transistor, is equivalent to Q3 and, device Q20, an NPN bipolar transistor, is equivalent to Q4 in the patent. These devices comprise the core of the temperature stable bias circuit and provide the known reference current for the rest of the virtual ground circuit depicted in FIGS. 2 and 3. The remainder of the devices on the bias circuit schematic FIG. 4A (JP36, Q17, Q18, Q19, Q21, Q40 & Q41) are used to ratio and mirror the reference current and to provide additional stability over supply variation.

The advantages of this temperature stable bias circuit are many fold. The primary advantage of the temperature stable bias source 39 is that it allows the op amp 47 to keep a constant full power bandwidth over temperature. As discussed in above in reference to the operation of the op amp 47, a high full power bandwidth is desirable. Since the temperature stable bias source 39 allows the op amp 47 to maintain a fairly constant full power bandwidth over temperature, the user can expect the virtual ground circuit to have the same frequency (AC) performance over temperature as it exhibits at room temperature. As stated above, additional components were added, using standard techniques, that increase the stability of the reference current over supply variation. As the supply is varied, the reference current remains constant. Thus the accuracy and the AC performance of the virtual ground circuit remains constant as the supply voltage is varied. No matter what temperature, power dissipation or supply voltage the user operates the circuit at (within the recommended operating range), accuracy, and AC parameters that vary due to bias current stability, are held constant. This is a significant advantage over the prior art approaches.

A secondary advantage of bias circuit 39 relates to the current that flows from the op amp 47 terminal labeled NOISE REDUCTION. This current also flows from the mid-point of the resistor network comprised of resistors 43 and 45. This current causes an error in the reference voltage. The temperature stable bias source 39 allows this op amp terminal current to be more stable over temperature than otherwise possible and thus reduces the temperature variation of the error term due to this terminal current.

FIG. 4B depicts the schematic diagram of the VIO TRIM circuit 51. This circuit is used to minimize another output voltage error term generated by the op amp 47. The offset voltage of the op amp adds (or subtracts) from the voltage reference developed by the bandgap reference 41. Thus, the output voltage of the virtual ground does not equal the reference voltage generated by the bandgap reference 41. The trim circuit 51 allows the offset voltage of the op amp 47 to be trimmed to a very low value so that the output voltage $V_o$ is as close as possible to the reference voltage generated by the bandgap reference 41.

The virtual ground circuit depicted in FIGS. 2–4 provides a stable, accurate, split rail voltage output based on the voltage reference provided by the resistor divider circuit of FIG. 2. Typical applications call for a reference voltage of 50% of the supply voltage. The circuit in FIG. 2 has been produced and has been found to provide a well regulated reference voltage with plus or minus 20 mA of output current drive (source or sink) over a supply voltage range of 4–40 V.

As shown in FIG. 2, the performance of the virtual ground circuit can be enhanced by coupling an additional user selectable capacitor between the noise reduction input and the common voltage. This requires an additional component and additional connections, and so the use of this embodiment should be restricted to applications where the enhanced performance is necessary.

Figure 5:
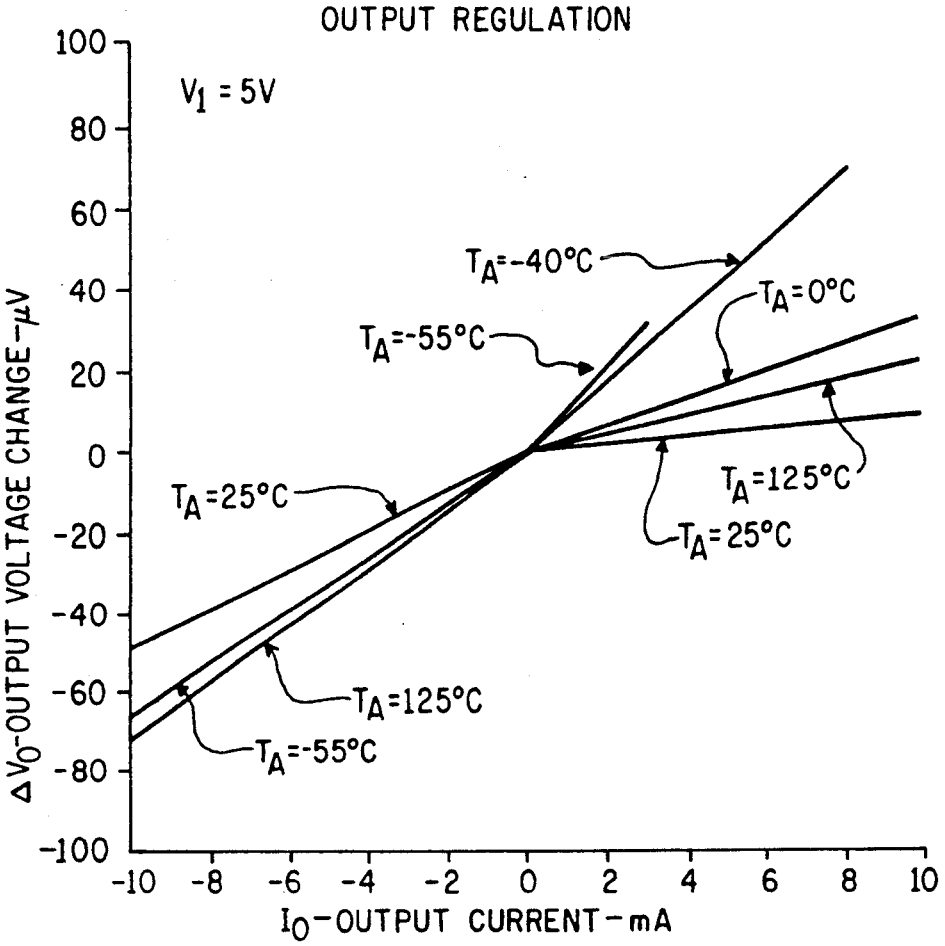
FIG. 5 depicts the output regulation performance of the circuit of FIGS. 2–4 over a range of temperatures.

FIG. 5 depicts the output regulation performance of the circuit depicted in FIGS. 2–4 over a variety of temperature conditions.

Figure 6:
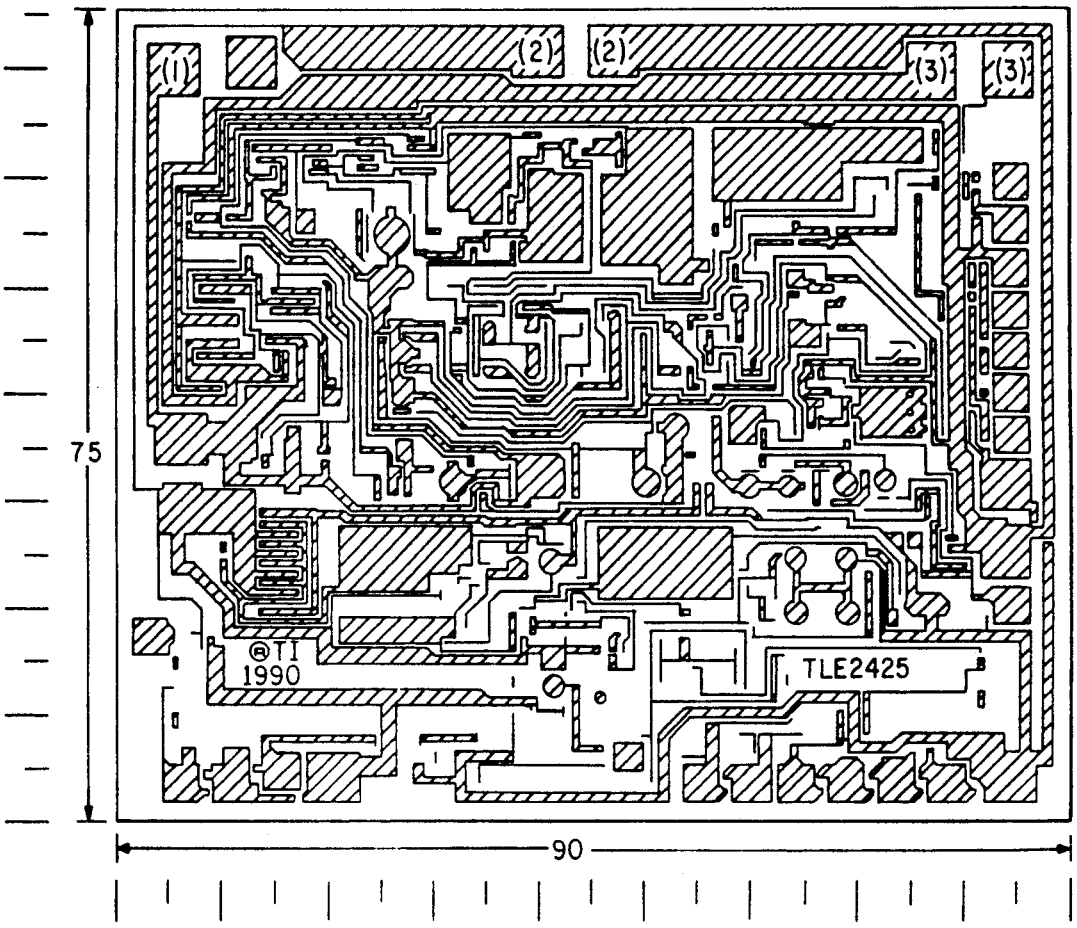
FIG. 6 depicts an integrated circuit implementing the circuit of FIG. 2.

FIG. 6 depicts an integrated circuit embodying the virtual ground circuit of FIG. 2. Note that the bond pads labeled (2) and (3) are the common and $V_{in}$ terminals, respectively. In order to improve the noise rejection and performance of the integrated circuit, the low and high current use paths are physically separated, and the final connection of these paths to the input voltage pin and the common pin are made with bond wires.

The integrated circuit in FIG. 6 can also be produced embodying the invention disclosed in patent application Ser. No. 758,669 filed Sep. 12, 1991, entitled "Fixed Virtual Ground Voltage Generator for Single Supply Analog Systems", and the chip can be fabricated in such a way that by selectively programming on-chip fuses, the circuit described in FIGS. 2–4 of this application is created. In this way a single die of an integrated circuit can be produced, and the inventions of both this application and the cross-referenced application may be selectively chosen after fabrication by selective programmation of the fuses.

Figure 7B:
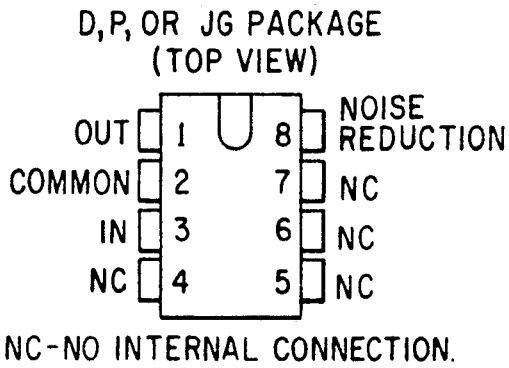
FIGS. 7*a* and 7*b* depict two embodiments of packaged integrated circuits implementing the circuit of FIG. 2.
Figure 7A:
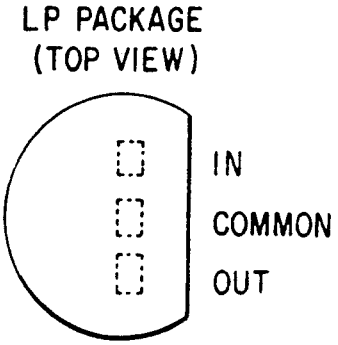

FIGS. 7A and 7B depict packaged dies of an integrated circuit embodying the invention depicted in FIG. 6. In FIG. 7A, the package depicted is a small area, three terminal package device particularly suited to applications where discrete components were used previously. This simple package allows easy upgrade of existing circuit board designs without new maskwork, the three terminal package is simply inserted so that the Vin terminal is at the supply voltage, the COM terminal is at ground or common, and the $V_o$ pin is at the virtual ground terminal. Circuit interconnection in the package is designed to minimize noise problems. Certain signals are connected by means of bond wires. This gives better load rejection.

FIG. 7B depicts an alternative package. Here, the integrated circuit die is packaged in an eight pin dual-in-line plastic package (DIP) as is well known in the art. Again, some of the connections are made using bond wires, to improve the noise rejection of the circuit. This package is appropriate for some applications where the DIP is preferred for its low profile and compatibility with other DIP packages, and is also preferred for applications where the NOISE REDUCTION connection is required, as the three pin packaging of FIG. 7A. does not make this connection available.

A few preferred embodiments have been described in detail hereinabove. It is to be understood that the scope of the invention also comprehends embodiments different from those described, yet within the scope of the claims.

For example, color display devices can be raster-scanned cathode ray tubes or other raster-scanned devices; devices that are not raster-scanned and have parallel line or frame drives; color printers, film formatters, or other hard copy displays; liquid crystal, plasma, holographic, deformable micromirror, or other displays of non-CRT technology; or three-dimensional or other devices using nonplanar image formation technologies.

"Microcomputer" in some contexts is used to mean that microcomputer requires a memory and "microprocessor" does not. The usage herein is that these terms can also be synonymous and refer to equivalent things. The phrase "processing circuitry" comprehends ASICs (application specific integrated circuits), PAL (programmable array logic), PLAs (programmable logic arrays), decoders, memories, non-software based processors, or other circuitry, or digital computers including microprocessors and microcomputers of any architecture, or combinations thereof. Words of inclusion are to be interpreted as nonexhaustive in considering the scope of the invention.

Internal and external connections can be ohmic, capacitive, direct or indirect, via intervening circuits or otherwise. Implementation is contemplated in discrete components or fully integrated circuits in silicon, gallium arsenide, or other electronic materials families, as well as in optical-based or other technology-based forms and embodiments. It should be understood that various embodiments of the invention can employ or be embodied in hardware, software or microcoded firmware. Process diagrams are also representative of flow diagrams for microcoded and software based embodiments.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A rail splitting virtual ground generator circuit, comprising:

first and second resistors, coupled to an voltage reference node and further coupled between first and second supply voltages, operable such that a predetermined reference voltage is available at the voltage reference node;

a bias current source coupled to said first supply voltage;

an operational amplifier coupled to said reference voltage in a unity gain configuration, having an output coupled to an output terminal, and powered by said bias current source and said second supply voltage;

a noise reduction input coupled to said reference voltage; and operable to provide a stable voltage at the output terminal which is equal to half the difference between said first and second supply voltages over a wide range of supply voltage and temperature conditions.

2. The rail splitting virtual ground generator circuit of claim 1, and further comprising:

a first capacitor coupled between said voltage reference node and said second supply voltage, operable for reducing signal noise at the voltage output.

3. The rail splitting virtual ground generator circuit of claim 1, wherein said bias current source further comprises transistors coupled for providing a reference current of a predetermined value, and further comprising transistors coupled as compensation circuitry, operable so that current variations with in the bias source due to ambient temperature variations do not change the reference current value.

4. The rail splitting virtual ground generator circuit of claim 3 wherein said compensation circuitry comprises BET transistors.

5. The rail splitting virtual ground generator circuit of claim 3 wherein said compensation circuitry comprises isolated vertical bipolar transistors.

6. The rail splitting virtual ground generator circuit of claim 1, wherein said operational amplifier further comprises one differential input coupled to said reference voltage and a second differential input coupled to said voltage output.

7. The rail splitting virtual ground generator circuit of claim 1, wherein said operational amplifier further comprises an output stage coupled to said output terminal and further coupled to a boost stage, said boost stage operable to provide additional current sinking or sourcing capability when the current flowing through the output stage exceeds a predetermined threshold.

8. The rail splitting virtual ground generator circuit of claim 7 wherein said operational amplifier output stage further comprises a sensing transistor coupled to said boost stage, and operable to turn on said boost stage when the current flowing through the conduction path of said sensing transistor exceeds a certain threshold.

9. The rail splitting virtual ground generator circuit of claim 8, wherein said boost stage of said operational amplifier comprises a first and second bipolar transistor, each having its base coupled to said sensing transistor, and each having its conduction path coupled between said voltage output and one of said voltage supplies, operable to provide increased current flow through the conduction paths of said first or second transistor when the current flowing at the voltage output exceeds said predetermined threshold.

10. The rail splitting virtual ground generator circuit of claim 7, wherein said output stage is coupled to a plurality of gain stages, coupled together and further coupled to said voltage reference node, operable to provide a large gain in signal amplitude from said voltage reference to said output stage.

11. The rail splitting virtual ground generator circuit of claim 1, wherein said operational amplifier is comprised of isolated vertical bipolar transistors coupled to form differential input stage, a plurality of gain stages coupled together and to the differential input stage, and an output stage coupled to said voltage output.

12. The rail splitting virtual ground generator circuit of claim 1, wherein said operational amplifier further comprises a plurality of resistors coupled with programmable fuses, operable to allow selective programmation of the offset voltage of said operational amplifier, to allow minimization said offset voltage.

13. A method for creating a virtual ground reference voltage for use in a single supply system, comprising the steps of:

providing a pair of precision resistors coupled between a first and second voltage supply;

providing a temperature stable bias current source coupled to said first voltage supply;

providing an operational amplifier having increased current drive capability, powered by said bias current source and said second voltage supply;

coupling a predetermined reference voltage produced by the said pair of precision resistors one input terminal of said operational amplifier;

coupling the output of said operational amplifier to a voltage output terminal, and further coupling said voltage output terminal to a second input terminal of said operation amplifier; and operating said operational amplifier in a unity gain configuration so as to provide a voltage at the voltage output terminal that is one half the difference in said first and second supply voltages.

14. The method of claim 13, and further comprising the step of:

coupling a capacitor between said reference voltage and said second voltage supply to reduce the signal noise at the output terminal.

15. The method of claim 14, wherein said step of providing an operational amplifier comprises providing an operational amplifier fabricated from isolated vertical bipolar transistors.

16. The method of claim 15, wherein said step of providing an operational amplifier further comprises providing an operational amplifier having a boost circuit comprising a first and second isolated vertical bipolar transistor each having their conduction paths coupled between said output voltage terminal and one of said first and second voltage supplies.

17. An integrated circuit implementing a virtual ground reference voltage circuit, comprising:

first and second voltage supply terminals;

a voltage output terminal;

first and second resistors, coupled to an voltage reference node and further coupled between said first and second supply voltages, operable such that a predetermined reference voltage is available at the voltage reference node;

a bias current source coupled to said first supply voltage;

an operational amplifier coupled to said reference voltage in a unity gain configuration, having an output coupled to said output terminal, and powered by said bias current source and said second supply voltage;

a noise reduction input coupled to said reference voltage; and operable to provide a stable voltage at the output terminal which is equal to half the difference between said first and second supply voltages over a wide range of supply voltage and temperature conditions.

18. The integrated circuit of claim 17, and further comprising:

a noise reduction terminal coupled to said reference voltage, operable to selectively allow coupling of a capacitor between said noise reduction terminal and said second voltage supply for reducing signal noise at said output voltage terminal.

19. A rail splitting virtual ground generator circuit, comprising:

a resistor voltage divider coupled between first and second supply voltages operable to provide a predetermined reference voltage;

a bias current source coupled to said first supply voltage;

an amplifier coupled to said reference voltage and having an output coupled to an output terminal, said amplifier being powered by said bias current source; and operable to provide a stable voltage at the output terminal which is equal to half the difference of said first and second supply voltages.

20. The rail splitting virtual ground generator circuit of claim 19, and further comprising a noise reduction input coupled to said reference voltage.

21. The rail splitting virtual ground generator circuit of claim 20, and further comprising a first capacitor coupled between said voltage reference node and said second supply voltage, operable for reducing signal noise at the output terminal.

22. The rail splitting virtual ground generator circuit of claim 19, wherein said bias current source further comprises transistors coupled for providing a reference current of a predetermined value, and further comprising transistors coupled as compensation circuitry, operable so that current variations within the bias current source due to ambient temperature variations do not change the reference current value.

23. The rail splitting virtual ground generator circuit of claim 19, wherein said amplifier comprises an operational amplifier coupled in a unity gain configuration.

24. The rail splitting virtual ground generator circuit of claim 23, wherein said operational amplifier further comprises an output stage coupled to a boost stage, said boost stage operable to provide additional current sourcing or sinking capability when the current flowing through said output stage exceeds a certain threshold.

25. The rail splitting virtual ground generator circuit of claim 24, wherein said operational amplifier further comprises a sensing transistor coupled to said boost stage and operable to turn on said boost stage when the current flowing through the conduction path of said sensing transistor exceeds a certain threshold.

26. A method for creating a rail splitting virtual ground generator circuit, comprising the steps of:

providing a resistor voltage divider coupled between first and second supply voltages operable to provide a reference voltage;

providing a bias current source coupled to said first supply voltage;

providing an amplifier coupled to said reference voltage and having an output coupled to an output terminal, said amplifier being powered by said bias current source; and operating said amplifier and bias current source to provide a stable voltage at the output terminal which is equal to half the difference of said first and second supply voltages.

27. The method of claim 26, and further comprising the step of coupling a capacitance between said reference voltage and said second voltage supply to reduce the signal noise at the output terminal.

28. The method of claim 26, wherein said step of providing an amplifier coupled to said reference voltage comprises providing an operational amplifier coupled in a unity gain configuration and having increased current drive capability.

29. The method of claim 28, wherein said step of providing an operational amplifier further comprises the steps of:

providing a plurality of isolated bipolar transistors coupled to form a differential input stage, providing a plurality of gain stages coupled together and to the differential input stage; and providing an output stage coupled to the voltage output and to said plurality of gain stages.

30. The method of claim 29, wherein said step of providing a bias current source comprises selecting a bias current circuit which has a stable output which remains constant over a wide range of temperature and voltage conditions.

* * * * *